US009382734B2

(12) United States Patent
Rosales et al.

(10) Patent No.: US 9,382,734 B2
(45) Date of Patent: Jul. 5, 2016

(54) DOOR HANDLE ARRANGEMENT

(71) Applicant: Brose Schliesssysteme GmbH & Co. KG, Wuppertal (DE)

(72) Inventors: David Rosales, Rochester Hills, MI (US); Michael Wittelsbuerger, Lake Orion, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 90 days.

(21) Appl. No.: 14/081,794

(22) Filed: Nov. 15, 2013

(65) Prior Publication Data

US 2015/0137535 A1 May 21, 2015

(51) Int. Cl.

| | |
|---|---|
| ***E05B 3/00*** | (2006.01) |
| ***E05B 79/06*** | (2014.01) |
| ***E05B 79/20*** | (2014.01) |
| ***E05B 85/16*** | (2014.01) |
| *E05B 1/00* | (2006.01) |
| *E05B 85/14* | (2014.01) |
| *E05B 7/00* | (2006.01) |
| *E05B 85/10* | (2014.01) |

(52) U.S. Cl.

CPC ..... *E05B 79/06* (2013.01); *E05B 79/20* (2013.01); *E05B 85/16* (2013.01); *E05B 1/003* (2013.01); *E05B 7/00* (2013.01); *E05B 85/10* (2013.01); *E05B 85/14* (2013.01); *Y10T 29/4984* (2015.01); *Y10T 292/57* (2015.04)

(58) Field of Classification Search

CPC ..... E05B 1/003; E05B 7/00; E05B 85/10; E05B 85/14; E05B 85/16

USPC ..... 292/336.3

See application file for complete search history.

(56) References Cited

U.S. PATENT DOCUMENTS

| | | | | | |
|---|---|---|---|---|---|
| 4,883,296 | A * | 11/1989 | Laurie | E05B 9/082 | 292/336.3 |
| 5,039,145 | A * | 8/1991 | Frye | E05B 85/12 | 292/143 |
| 5,685,581 | A * | 11/1997 | Kritzler | E05B 85/16 | 292/336.3 |
| 6,007,122 | A * | 12/1999 | Linder | E05B 85/10 | 292/216 |
| 6,240,755 | B1 * | 6/2001 | Da Silva | E05B 17/186 | 292/336.3 |
| 7,971,460 | B2 * | 7/2011 | Zagoroff | B62D 33/037 | 292/336.3 |
| 2013/0147213 | A1 * | 6/2013 | Muller | E05B 77/06 | 292/336.3 |

FOREIGN PATENT DOCUMENTS

| | | |
|---|---|---|
| DE | 10222289 | 11/2003 |

* cited by examiner

*Primary Examiner* — Carlos Lugo

(74) *Attorney, Agent, or Firm* — Pauly, Devries Smith & Deffner, LLC

(57) ABSTRACT

The invention is directed to a door handle arrangement for a motor vehicle door, wherein a door handle is provided and wherein in the installed state a hinge mechanism is provided which allows pivoting of the door handle for its manual actuation. It is proposed that in the installed state, for fixing the door handle to a door shell section of the motor vehicle door, the door shell section is clamped from both of its sides between a first clamping surface of the door handle and a second clamping surface of a clamping element, wherein the clamping engagement between the clamping surfaces and the door shell section provide the hinge mechanism for the door handle such that the clamping force flows through the hinge mechanism.

19 Claims, 5 Drawing Sheets

DOOR HANDLE ARRANGEMENT

FIELD OF THE INVENTION

The invention is directed to a door handle arrangement for a door of a motor vehicle and a method for installing a door handle arrangement.

BACKGROUND

The expression "motor vehicle door" is to be understood in a broad sense. It includes in particular side doors, back doors, lift gates, trunk lids or engine hoods. Such a door may generally be designed as a sliding door as well.

The known door handle arrangement (DE 102 22 289 A1), which is the starting point for the invention, is being arranged at an outer door shell of the motor vehicle door, while in the installed state. A bow shaped door handle is provided, which bow shaped door handle comprises a first end section and a second end section. On one end section a hinge mechanism is provided, whereas on the second end section a mechanical interface is provided. The mechanical interface allows the attachment of a mechanical transmission element for the transmission of an actuation of the door handle to a door lock.

In the present context, the "actuation" of the door handle is being transmitted to the door lock in order to actuate the door lock and thereby to open the motor vehicle door. The mechanical transmission element of the known door handle arrangement is realized as a rod arrangement.

Generally, for the above noted door handle arrangements, a number of challenges have to be met. Besides low weight, low complexity in construction and high mechanical robustness a major challenge is the easy installation of the door handle arrangement.

One problem connected to the known door handle arrangement goes back on the structure of the hinge mechanism. The hinge mechanism comprises a bearing bracket with a bearing pin, which bearing bracket is fixed to the respective door shell section via a screw connection. During installation, first the bearing bracket is being fixed to the door shell section. In a second step the door handle with a U-shaped bearing surface is brought into engagement with the bearing pin, such that the hinge mechanism is completed. This installation procedure requires two separate installation steps for fixing the bearing bracket to the door shell section and for completing the hinge mechanism.

It is the object underlying the invention to improve the known door handle arrangement such that the installation is simplified taking into account the goals of low weight, low constructional complexity and high mechanical robustness.

SUMMARY

The basic idea underlying the invention is to merge the function of fixing the door handle to the door shell section and the function of providing a hinge mechanism. It has been found that this merger of functions may be achieved with simple construction, when the door shell section is clamped from both of its sides between a first clamping surface of the door handle and a second clamping surface of a clamping element. This goes back on the fact that the hinge mechanism as well as the clamping of the door shell section requires the engagement of at least two surfaces engaging each other. According to the invention, the engagement necessary for the hinge mechanism and the engagement necessary for clamping of the door shell section have been merged into one single engagement.

As a result it is proposed that the clamping engagement between the clamping surfaces and the door shell section not only fixes the door handle to the door shell section but also provides the hinge mechanism for the door handle such that the clamping force flows through the hinge mechanism. With the proposed solution both functions, namely fixing of the door handle to the door shell section and providing a hinge mechanism, may be realized by only one single constructional measure. This reduces complexity and cost and also simplifies installation.

In some embodiments, the door handle is of bow like design and comprises along its extension a first end section and a second end section. For such basic structure the proposed solution allows particularly simple construction.

According to an embodiment, the clamping element may be snap fitted to the door handle for creating the above noted clamping engagement. This allows a simplified installation of the door handle arrangement, which is subject of an additional teaching.

An embodiment is directed to a realization of the hinge mechanism. Here it is proposed that the clamping element with the second clamping surface is rolling off a surface of the door shell section. The expression "rolling off" is to be understood in a broad sense. For example, in addition to the rolling off movement any kind of sliding movement and/or deformation may occur, which may contribute to the characteristics of the hinge mechanism.

In an embodiment, it may also be advantageous that the clamping element with the second clamping surface is pivotably supported at a surface of the door shell section providing a resulting pivot movement of the door handle. While the above noted rolling off movement leads to a moving geometrical pivot axis, the pivotable support of the clamping element provides for a stationary geometrical pivot axis.

The clamping element may also serve an additional function, namely the function of the attachment of a transmission element to a door lock. Here the clamping element provides a mechanical interface for such attachment. This triple use of the clamping element, namely for fixing the door handle, for providing the hinge mechanism and for providing a mechanical interface for the attachment of a transmission element leads to a particularly compact construction. In an embodiment, the mechanical interface can include a bowden cable.

An embodiment is directed to a motor vehicle door with a door handle arrangement, which can be a door handle arrangement according to the first teaching. Insofar all explanations given for the first teaching are applicable to the motor vehicle door as well.

For the second teaching it is of particular importance again that the door shell section is clamped from both of its sides as noted above and that the clamping surfaces and the door shell section provide the hinge mechanism for the door handle such that the clamping force flows through the hinge mechanism.

In an embodiment, in the area of the door handle arrangement, a reinforcement plate is provided, which mainly serves as a support of the door handle arrangement in the case of high actuation forces. With this reinforcement plate the door shell section as such may be of a mechanically weak and therewith low cost material.

An additional embodiment is directed to a method for the installation of a door handle arrangement, which can be a door handle arrangement as proposed with the first teaching. Insofar all explanations given to the prior teachings are applicable to the proposed method.

It is of particular importance for the proposed method that for fixing the door handle to a door shell section of the motor vehicle door, in a first step the door handle is positioned at the door shell section and in a second step a clamping element is detachably fitted, in particular snap fitted, to the door handle, such that the door shell section is clamped between a first clamping surface of the door handle and a second clamping surface of the clamping element. With this second step the hinge mechanism is completed, wherein the clamping engagement between the clamping surfaces and the door shell section provides the hinge mechanism for the door handle such that the clamping force flows through the hinge mechanism.

With the proposed method it is possible to fix the door handle to the door shell section and to complete the hinge mechanism by only a single installation step, namely by fitting the clamping element to the door handle. This simplification of installation leads to a considerable decrease in production costs.

In an embodiment, the invention provides a door handle arrangement for a motor vehicle door, wherein a door handle is provided and wherein in the installed state a hinge mechanism is provided which allows pivoting of the door handle for its manual actuation, wherein in the installed state, for fixing the door handle to a door shell section of the motor vehicle door, the door shell section is clamped from both of its sides between a first clamping surface of the door handle and a second clamping surface of a clamping element, wherein the clamping engagement between the clamping surfaces and the door shell section provides the hinge mechanism for the door handle such that the clamping force flows through the hinge mechanism.

In an embodiment, the door handle is of bow like design and comprises along its extension a first end section and a second end section.

In an embodiment, the hinge mechanism is located in the area of the first end section and that manual actuation of the door handle is a movement of the second end section away from the door shell section.

In an embodiment, the door shell section is part of an outer door shell, which together with an inner door shell encloses a hollow interior of the motor vehicle door and that in the installed state the first clamping surface is in contact with an outer surface of the door shell section and that the second clamping surface is in contact with an inner surface of the door shell section.

In an embodiment, the clamping element is moveably coupled to the door handle, or, that the clamping element is fixedly coupled to the door handle.

In an embodiment, in the installed state the door handle in the area of its first end section is coupled to the clamping element.

In an embodiment, the clamping element is fitted to the door handle.

In an embodiment, during actuation of the door handle the clamping element with the second clamping surface is rolling off a surface of the door shell section providing a resulting pivot movement of the door handle.

In an embodiment, during actuation of the door handle the clamping element with the second clamping surface is pivotably supported at a surface of the door shell section providing a resulting pivot movement of the door handle.

In an embodiment, a mechanical interface is provided for the attachment of a transmission element, which in the installed state transfers actuation movements of the door handle to a door lock and that the mechanical interface is provided by the clamping element.

In an embodiment, the mechanical interface is provided in the area of the first end section of the door handle.

In an embodiment, the mechanical interface is designed for the attachment of a bowden cable.

In one embodiment, the invention provides a motor vehicle door with a door handle arrangement, wherein the door handle arrangement comprises a door handle and wherein a hinge mechanism is provided which allows pivoting of the door handle for its manual actuation, wherein for fixing the door handle to a door shell section of the motor vehicle door, the door shell section is clamped from both of its sides between a first clamping surface of the door handle and a second clamping surface of a clamping element, wherein the clamping engagement between the clamping surfaces and the door shell section provides the hinge mechanism for the door handle such that the clamping force flows through the hinge mechanism.

In an embodiment, the door shell section, in the area of the door handle arrangement, is provided with a reinforcement plate.

In one embodiment, the invention provides a method for the installation of a door handle arrangement, wherein the door handle arrangement comprises a door handle and wherein in the installed state a hinge mechanism is provided which allows pivoting of the door handle for its manual actuation, wherein for fixing the door handle to a door shell section of the motor vehicle door, in a first step the door handle is positioned at the door shell section and in a second step a clamping element is fitted to the door handle, such that the door shell section is clamped between a first clamping surface of the door handle and a second clamping surface of the clamping element, wherein the clamping engagement between the clamping surfaces and the door shell section provides the hinge mechanism for the door handle such that the clamping force flows through the hinge mechanism.

In an embodiment, a coupling element of the door handle is coupled to the clamping element.

In an embodiment, the clamping element is snap fitted to the door handle.

In an embodiment, the clamping element is fitted to the coupling element of the door handle.

In an embodiment, the second clamping surface is extending along a curve.

In an embodiment, the second clamping surface is extending along a circular curve.

In an embodiment, the bowden cable may be wound onto or unwound from the clamping element.

In an embodiment, the reinforcement plate is directly connected to the door shell section.

BRIEF DESCRIPTION OF THE FIGURES

In the following the invention will be described in examples referring to the drawings. In the drawings show FIG. 1 a proposed motor vehicle door with a proposed door handle arrangement, FIG. 2 the motor vehicle door according to FIG. 1 in sectional view II-II a) with the door handle in the non-actuated state and b) with the door handle in the actuated state, FIG. 3 the motor vehicle door according to FIG. 2*a*) in view III, FIG. 4 a second embodiment of the motor vehicle door according to FIG. 1 in sectional view II-II a) with the door handle in the non-actuated state and b) with the door handle in the actuated state and FIG. 5 the motor vehicle door according to FIG. 4) in view III.

DETAILED DESCRIPTION

Figure 2:
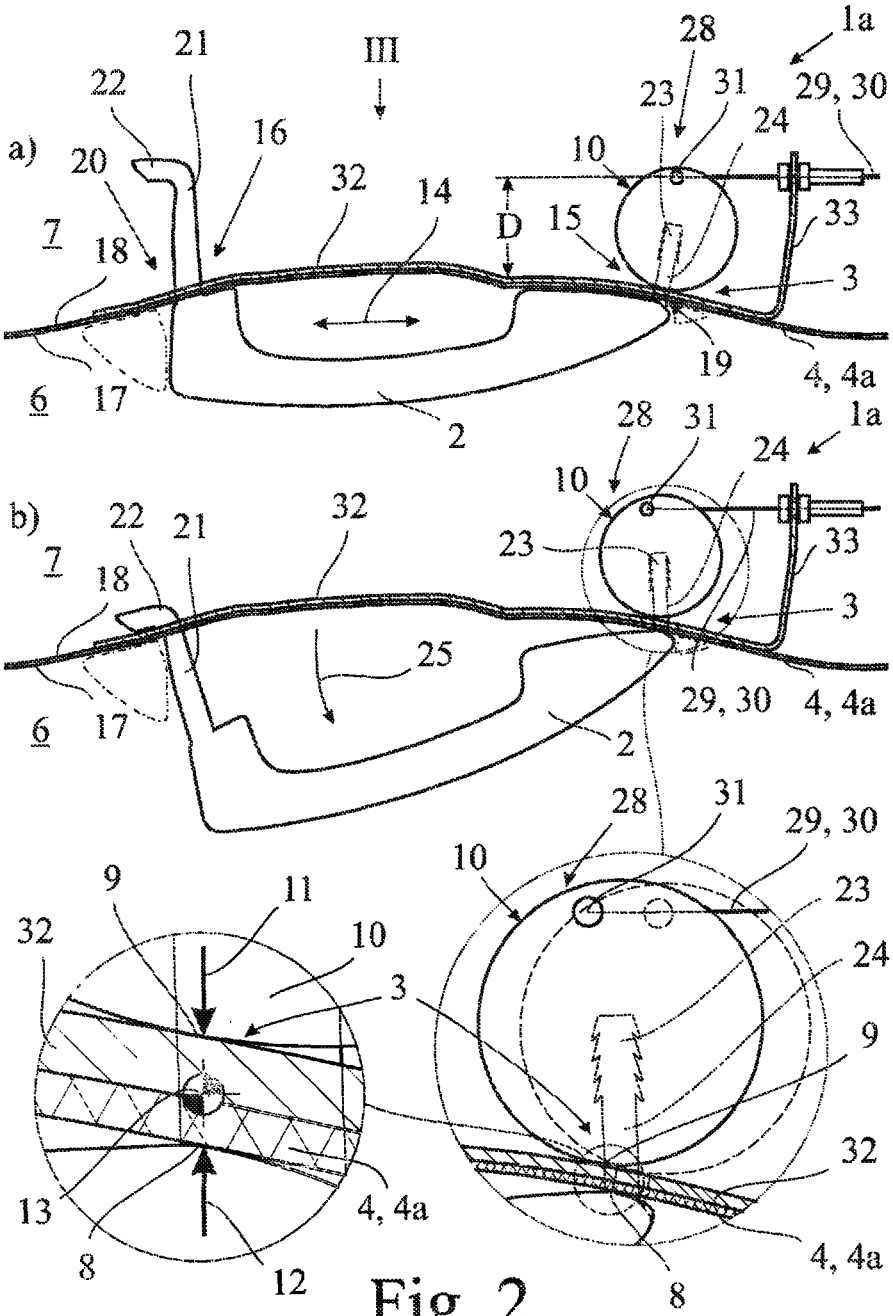
Figure 4:
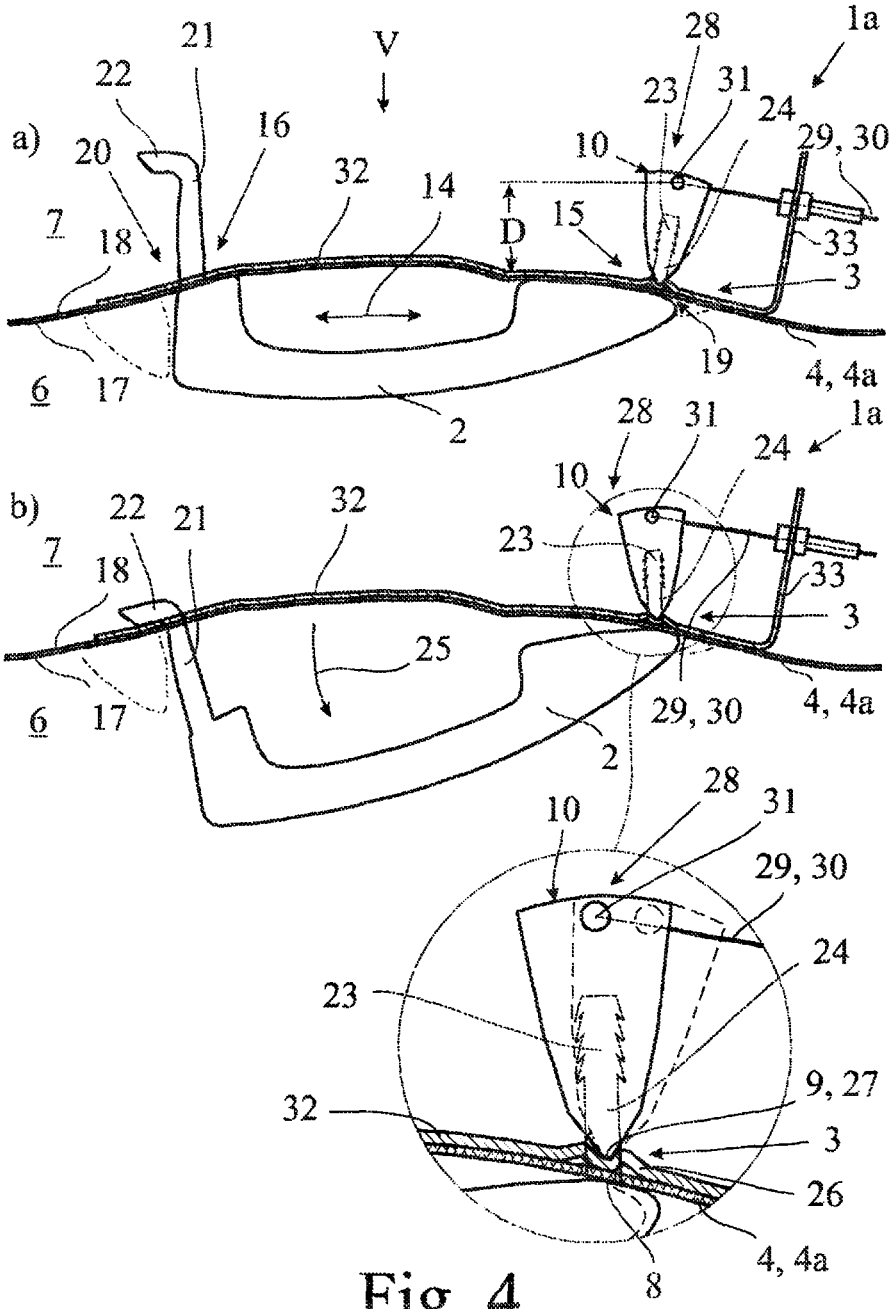

The two embodiments for a proposed door handle arrangement shown in FIG. 2, 3 and in FIG. 4, 5 are of identical overall structure. For this reason, those components with identical functionality have been assigned the same reference numbers.

Figure 1:
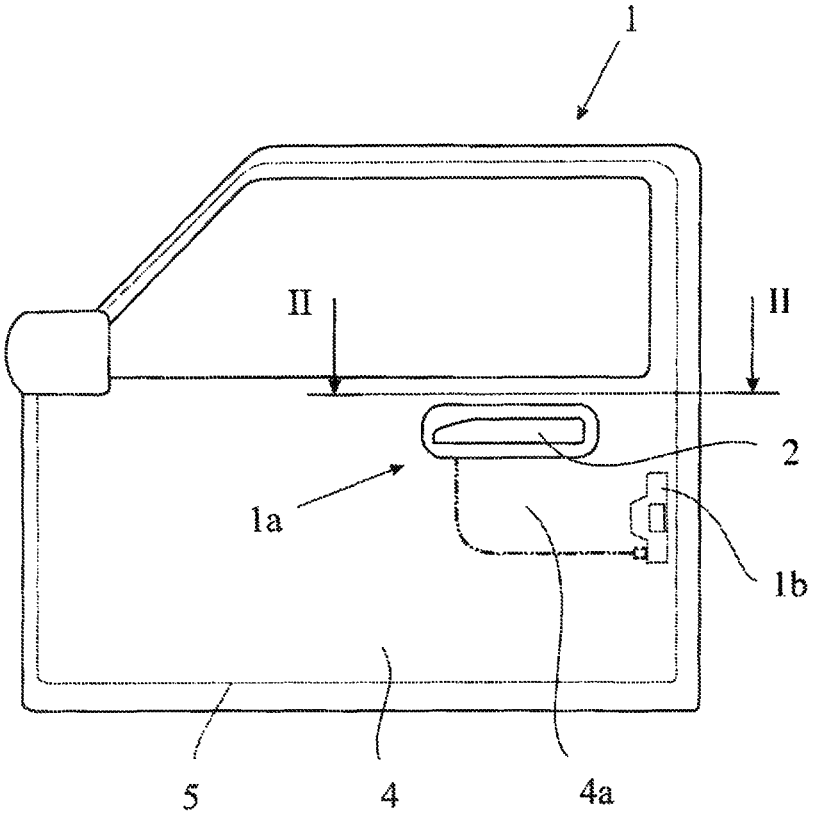

The motor vehicle door 1 shown in FIG. 1 comprises a door handle arrangement 1*a* and a door lock 1*b*, which components are only displayed rudimentarily for general understanding.

FIGS. 2 and 4 show that a door handle 2 is provided. FIGS. 2*a* and 2*b* in combination, and FIGS. 4*a* and 4*b* in combination respectively, show that in the installed state a hinge mechanism 3 is provided which allows pivoting of the door handle 2 for its manual actuation. In FIGS. 2 and 4 the manual actuation goes back on pivoting of the door handle 2 in an anti-clockwise direction.

The motor vehicle door 1 comprises an outer door shell 4, which is facing the outside of the motor vehicle and an inner door shell 5, which is facing the inside of the motor vehicle. The outer door shell 4 and the inner door shell 5 enclose an inner volume of the motor vehicle door 1, in which, for example, the door lock 1*b* and at least part of the door handle arrangement 1*a* are located.

In the installed state, for fixing the door handle 2 to a door shell section 4*a* of the outer door shell 4 of the motor vehicle door 1, the door shell section 4*a* is clamped from both of its sides 6, 7 between a first clamping surface 8, which is assigned to the door handle 2, and a second clamping surface 9, which is assigned to a clamping element 10. The clamping engagement is indicated in the second detail view in FIG. 2*b* by the clamping force 11, 12 acting from the clamping surfaces 8, 9 onto the door shell section 4*a*. It may be taken from FIGS. 2 and 4 that such clamping engagement leads to a safe fixing of the door handle 2 to the door shell section 4*a*.

Interesting is the fact the clamping engagement between the clamping surfaces 8, 9 and the door shell section 4*a* provides the hinge mechanism 3 for the door handle 2 such that the clamping forces 11, 12 flows through the hinge mechanism 3. In other words: The geometry of the clamping surfaces 8, 9 and the door shell section 4*a* are designed such that pivoting of the door handle 2 is possible for manual actuation. This pivoting movement is only indicated in the second detail view in FIG. 2*b* by the geometrical pivot axis 13. During actuation of the door handle 2 this pivot axis 13 travels along the door shell section 4*a*, such that the expression "pivoting of the door handle" is to be understood in a broad sense.

In both embodiments the door handle 2 is of bow like design and comprises along its extension 14 a first end section 15 and a second end section 16. Here the hinge mechanism 3 is located in the area of the first end section 15, wherein a manual actuation of the door handle 2 is a movement of the second end section 16 away from the door shell section 4*a*. This may be taken from the sequence of FIG. 2*a* to FIG. 2*b* and from the sequence of FIG. 4*a* to FIG. 4*b*.

As noted above, the door shell section 4*a* is part of an outer door shell 4, which together with an inner door shell 5 encloses a hollow interior of the motor vehicle door 1, wherein in the installed state the first clamping surface 8 is in contact with an outer surface 17 of the door shell section 4*a* and wherein the second clamping surface 9 is in contact with an inner surface 18 of the door shell section 4*a*. With this overall structure only the door handle 2 of the door handle arrangement 1*a* is situated on the outer side 6 of the door shell section 4*a*.

The door shell section 4*a* comprises a first opening 19 and a second opening 20, wherein the first opening 19 serves for a connection between the clamping element 10 and the door handle 2 to be discussed, while the second end section 16 is assigned an extension piece 21 of the door handle 2, which extends through the second opening 20. Here the extension piece 21 provides an end stop 22 for the pivoting movement of the door handle 2 during actuation. When reaching the maximum pivot position (FIG. 2*b*, 4*b*) the end stop 22 comes into blocking contact with the door shell section 4*a*.

Here the clamping element 10 is coupled to the door handle 2. Generally this coupling may be a movable coupling, which allows a predetermined movement between the clamping element 10 and the door handle 2. Here, however, the clamping element 10 is fixedly coupled to the door handle 2. Other than a certain elasticity to be discussed, no movement between the door handle 2 and the clamping element 10 occurs.

In order to provide the hinge mechanism 3 at the first end section 15 of the door handle 2, in the shown embodiments, the door handle 2 in the area of its first end section 15 is coupled to the clamping element 10. This coupling is, as noted above, a fixed coupling, which can be a coupling between a coupling element 23 of the door handle 2 and the clamping element 10.

There are a number of possibilities for providing the coupling between the clamping element 10 and the door handle 2. In an embodiment, the clamping element 10 may be fitted to the door handle 2. Here the clamping element 10 is snap fitted to the door handle 2, which leads to a considerable simplification of the installation of the door handle arrangement 1*a*.

The drawings show that the clamping element 10 comprises a reception 24 for the coupling element 23 of the door handle 2. The coupling element 23 here is a pine tree clip, which provides a snap fit connection between those components. Insofar the expression "snap fit" is to be interpreted in a broad sense.

The embodiments shown in FIG. 2, 3 and in FIG. 4, 5 show two different embodiments to realize the hinge mechanism 3 by using the above noted clamping engagement.

Figure 3:
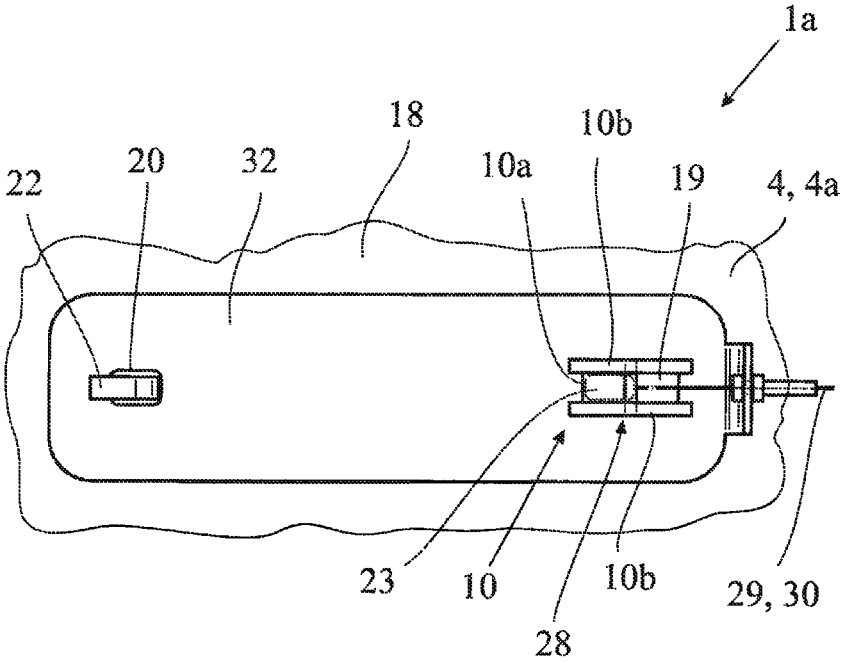
Figure 5:
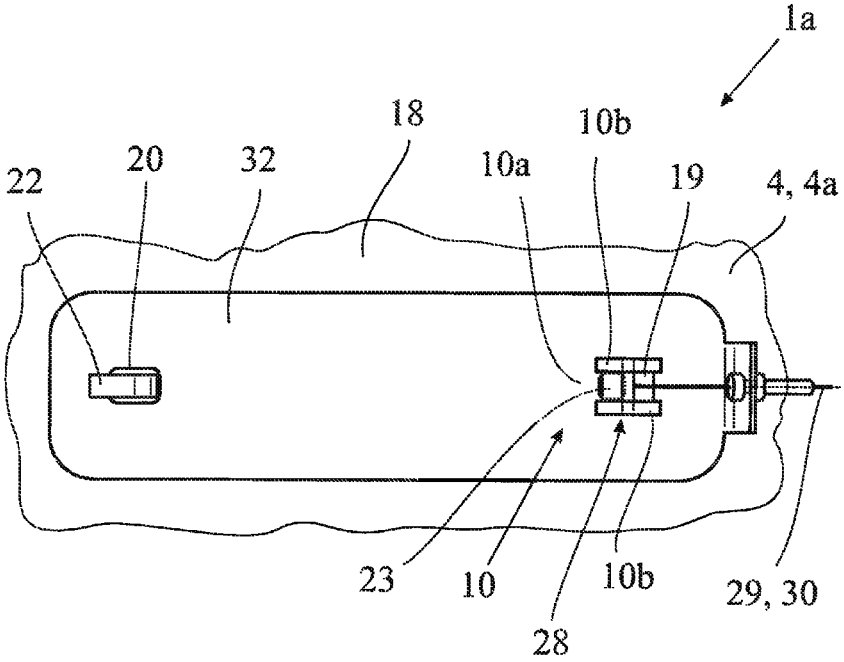

FIGS. 3 and 5 show that the coupling element 23 extends through the first opening 19, while the second clamping surface 9 of the clamping element 10 is arranged on both sides of the first opening 19. Accordingly the clamping element 10 comprises a central section 10*a* with the reception 24 and two plate like sections 10*b* on both sides of the first opening 19. The same is true for the embodiment shown in FIG. 4, 5. FIG. 2 shows that during actuation of the door handle 2 the clamping element 10 with the second clamping surface 9 is rolling off a surface of the door shell section 4*a* providing a resulting pivot movement 25 of the door handle 2. Due to the clamping engagement, the rolling off movement of the clamping element 10 mainly defines the pivot movement 25 of the door handle 2. It becomes clear from the first detail view in FIG. 2*b* that a certain elasticity is required within this clamping arrangement to allow the rolling off movement of the clamping element 10.

Depending on the area of application various surface designs for the second clamping surface 9 are possible. Here the second clamping surface 9 is extending along a curve, such as along a circular curve. Accordingly the two plates 10*b* are basically designed as wheels.

Another embodiment for the realization of the hinge mechanism 3 is based on the idea, that during actuation of the door handle 2 the clamping element 10 with the second clamping surface 9 is pivotably supported at the surface of the door shell section 4*a* providing a resulting pivot movement 25 of the door handle 2. The pivotable support of the clamping element 10 at the inner surface 18 of the door shell section 4*a* may be realized by an engagement section 26 at the door shell section 4*a*, which is in engagement with a counter engagement section 27 as shown in the detail view in FIG. 4*b*. The engagement between the clamping element 10 and the door shell section 4*a* provides the above noted pivotable support of the clamping element 10. In addition, this engagement provides the clamping engagement between the first clamping surface 8 of the door handle 2 and the second clamping surface 9 of the clamping element 10. For this clamping engagement the clamping element 10 shown in FIG. 4, 5 comprises a central section 10*a* and two plate like sections 10*b* as noted above.

Here the engagement section 26 at the door shell section 4*a* is of concave design in side view as shown in FIG. 4, while the counter engagement section 27 respectively is of convex design. This arrangement may be vice versa as well.

Again, for functioning of the door handle arrangement 1*a* shown in FIG. 4, in particular for the realization of the pivot movement 25, a certain elasticity is to be provided within the arrangement in order to prevent a blockage due to the clamping engagement.

The embodiments shown in the drawings include an additional function for the clamping element 10. Here the clamping element 10 also provides a mechanical interface 28 for the attachment of a transmission element 29, which in the installed state transfers actuation movements of the door handle 2 to the door lock 1*b*. As noted above, with this additional function the clamping element 10 provides altogether three functions, which leads to a simple design as shown in the drawings.

The mechanical interface 28, as shown in the drawings, is provided in the area of the first end section 15 of the door handle 2, which renders the construction especially compact. Generally it is also possible to provide the mechanical interface 28 in the area of the second section of the door handle 2, here the extension piece 21.

The mechanical interface 28 here is designed for the attachment of a bowden cable 30. In the shown embodiments the mechanical interface 28 is located between the plate like sections 10*b*. However, the bowden cable 30 may be wound onto or unwound from the clamping element 10, which makes it possible to modify the resulting gear ratio just by modifying the circumference of the clamping element 10.

Alternatively the mechanical interface 28 may be designed for the attachment of a rod arrangement instead of a bowden cable 30. The application of other transmission elements 29 is possible.

It may be taken from the drawings that in either embodiment high transmission forces in the bowden cable 30 may be realized with very low actuation forces. The reason for this is the fact that the distance D between the geometrical pivot axis 13 and the force application point 31 for the Bowden cable 30 at the clamping element 10 is considerably low.

There are numerous ways to create the clamping force 11, 12 during the installation of the door handle arrangement 1*a*. Here the clamping element 10 provides enough elasticity such that snap fitting the clamping element 10 onto the door handle 2 leads to elastic deformation of the clamping element 10 which again leads to the generation of clamping force 11, 12.

In an embodiment, the motor vehicle door 1 can include a door handle arrangement 1*a*. This door handle arrangement 1*a* is a door handle arrangement 1*a* as proposed above.

The door handle arrangement 1*a* comprises a door handle 2, wherein a hinge mechanism 3 is provided which allows pivoting of the door handle 2 for its manual actuation, as explained above.

It is of particular importance for the second teaching that for fixing the door handle 2 to a door shell section 4*a* of the motor vehicle door 1, the door shell section 4*a* is clamped from both of its sides 6, 7 between a first clamping surface 8 of the door handle 2 and a second clamping surface 9 of a clamping element 10, wherein the clamping engagement between the clamping surfaces 8, 9 and the door shell section 4*a* provides the hinge mechanism 3 for the door handle 2 such that the clamping force 11, 12 flows through the hinge mechanism 3. All explanations given for the first teaching are applicable to the second teaching respectively.

In an embodiment of the motor vehicle door 1 the door shell section 4*a*, in the area of the door handle arrangement 1*a*, is provided with a reinforcement plate 32, which here is directly connected to the door shell section 4*a*. For example, the reinforcement plate 32 may be welded, glued, snapped or the like to the door shell section 4*a*. In an embodiment the reinforcement plate 32 also provides a support section 33 for the support of other components, in particular for the support of the bowden cable 30. The support section 33 and the reinforcement plate 32 can be combined in a one piece component.

The reinforcement plate 32 may be a metal sheet, which can be bent in order to provide the support section 33. The reinforcement plate 32 may also be a plastic plate, as far as the material of the plastic plate provides for an increase of mechanical stability.

An embodiment can include a method for the installation of a door handle arrangement 1*a*, such as an above noted door handle arrangement 1*a*.

The basis for the third teaching is a door handle arrangement 1*a* which comprises a door handle 2, wherein in the installed state a hinge mechanism 3 is provided which allows pivoting of the door handle 2 for its manual actuation. According to the third teaching, for fixing the door handle 2 to a door shell section 4*a* of the motor vehicle door 1, in a first step the door handle 2 is positioned at the door shell section 4*a*. This position corresponds to the position shown in FIG. 2*a* and FIG. 4*a*. In a second step the above noted clamping element 10 is fitted, in particular snap fitted, to the door handle 2, such that the door shell section 4*a* is clamped between a first clamping surface 8 of the door handle 2, and a second clamping surface 9 of the clamping element 10. As a result the clamping engagement between the clamping surfaces 8, 9 and the door shell section 4*a* provide the hinge mechanism 3 for the door handle 2 such that the clamping force 11, 12 flows through the hinge mechanism 3. In an embodiment, during fitting the clamping element 10 to the door handle 2, in particular to the coupling element 23 of the door handle 2, the clamping force 11, 12 is created by elastic deformation of the arrangement, in particular of the clamping element 10.

Depending on the area of application it may be advantageous to attach the transmission element 29, here the bowden cable 30, to the clamping element 10 before fitting the clamping element 10 to the door handle 2. However, it is also possible to attach the transmission element 29 to the clamping element 10 after having fitted the clamping element 10 to the door handle 2.

From the above noted explanation it becomes clear that the installation of the door handle arrangement 1 according to the third teaching is considerably simplified.

The invention claimed is:

1. A door handle arrangement for a motor vehicle door, comprising:

a door handle, a hinge mechanism, the hinge mechanism comprises a clamping element wherein when the door handle is in the installed state, the hinge mechanism allows pivoting of the door handle for its manual actuation, wherein in the installed state, for fixing the door handle to a door shell section of the motor vehicle door, the door shell section is clamped from both of its sides between a first clamping surface of the door handle and a second clamping surface of the clamping element, wherein the clamping engagement between the clamping surfaces and the door shell section provides the hinge mechanism for the door handle such that a clamping force flows through the hinge mechanism, wherein a mechanical interface is provided for the attachment of a transmission element, which in the installed state transfers actuation movements of the door handle to a door lock and that the mechanical interface is provided by the clamping element.

2. The door handle arrangement according to claim 1, wherein the door handle is of a bow shaped design and comprises along its extension a first end section and a second end section.

3. The door handle arrangement according to claim 2, wherein the hinge mechanism is located in the area of the first end section and that manual actuation of the door handle is a movement of the second end section away from the door shell section.

4. The door handle arrangement according to claim 2, wherein in the installed state, the door handle in the area of its first end section is coupled to the clamping element.

5. The door handle arrangement according to claim 4, wherein the clamping element is fitted to the door handle.

6. The door handle arrangement according to claim 5, wherein the clamping element is fitted to the coupling element of the door handle.

7. The door handle arrangement according to claim 4, wherein a coupling element of the door handle is coupled to the clamping element.

8. The door handle arrangement according to claim 1, wherein the door shell section is part of an outer door shell, which together with an inner door shell encloses a hollow interior of the motor vehicle door and that in the installed state, the first clamping surface is in contact with an outer surface of the door shell section and that the second clamping surface is in contact with an inner surface of the door shell section.

9. The door handle arrangement according to claim 1, wherein the clamping element is moveably coupled to the door handle, or, that the clamping element is fixedly coupled to the door handle.

10. The door handle arrangement according to claim 1, wherein during actuation of the door handle, the clamping element with the second clamping surface is rolling off a surface of the door shell section providing a resulting pivot movement of the door handle.

11. The door handle arrangement according to claim 10, wherein the second clamping surface is extending along a curve.

12. The door handle arrangement according to claim 1, wherein during actuation of the door handle, the clamping element with the second clamping surface is pivotably supported at a surface of the door shell section providing a resulting pivot movement of the door handle.

13. The door handle arrangement according to claim 1, wherein the mechanical interface is provided in the area of the first end section of the door handle.

14. The door handle arrangement according to claim 1, wherein the mechanical interface is designed for the attachment of a bowden cable.

15. The door handle arrangement according to claim 14, wherein the bowden cable may be wound onto or unwound from the clamping element.

16. A motor vehicle door with a door handle arrangement, wherein the door handle arrangement comprises a door handle and wherein a hinge mechanism is provided which allows pivoting of the door handle for its manual actuation, wherein for fixing the door handle to a door shell section of the motor vehicle door, the door shell section is clamped from both of its sides between a first clamping surface of the door handle and a second clamping surface of a clamping element, wherein the clamping engagement between the clamping surfaces and the door shell section provides the hinge mechanism for the door handle such that the clamping force flows through the hinge mechanism, wherein a mechanical interface is provided for the attachment of a transmission element, which in the installed state transfers actuation movements of the door handle to a door lock and that the mechanical interface is provided by the clamping element.

17. The motor vehicle door according to claim 16, wherein the door shell section, in the area of the door handle arrangement, is provided with a reinforcement plate.

18. The motor vehicle door according to claim 17, wherein the reinforcement plate is directly connected to the door shell section.

19. A method for the installation of a door handle arrangement, wherein the door handle arrangement comprises a door handle and wherein in the installed state, a hinge mechanism is provided which allows pivoting of the door handle for its manual actuation, wherein for fixing the door handle to a door shell section of the motor vehicle door, in a first step, the door handle is positioned at the door shell section and in a second step, a clamping element is fitted to the door handle such that the door shell section is clamped between a first clamping surface of the door handle and a second clamping surface of the clamping element, wherein the clamping engagement between the clamping surfaces and the door shell section provides the hinge mechanism for the door handle such that the clamping force flows through the hinge mechanism, wherein a mechanical interface is provided for the attachment of a transmission element, which in the installed state transfers actuation movements of the door handle to a door lock and that the mechanical interface is provided by the clamping element.

* * * * *